US006903658B2

(12) United States Patent
Kane et al.

(10) Patent No.: US 6,903,658 B2
(45) Date of Patent: Jun. 7, 2005

(54) METHOD AND SYSTEM FOR ENSURING THAT A TRAIN OPERATOR REMAINS ALERT DURING OPERATION OF THE TRAIN

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 74 days.

(21) Appl. No.: 10/671,625

(22) Filed: Sep. 29, 2003

(65) Prior Publication Data

US 2005/0068184 A1 Mar. 31, 2005

(51) Int. Cl.[7] ..... G08B 23/00
(52) U.S. Cl. ..... 340/576; 180/272; 246/187 B
(58) Field of Search ..... 340/576, 502, 340/503, 575, 945; 246/1 R, 1 C, 28 R, 187 B, 253, 15; 180/272

(56) References Cited

U.S. PATENT DOCUMENTS

| | | | | |
|---|---|---|---|---|
| 4,181,943 A | | 1/1980 | Mercer, Sr. et al. | 364/426 |
| 4,196,412 A | * | 4/1980 | Sluis et al. | 340/901 |
| 4,459,668 A | | 7/1984 | Inoue et al. | 364/426 |
| 4,561,057 A | | 12/1985 | Haley, Jr. et al. | 364/436 |
| 4,711,418 A | | 12/1987 | Aver, Jr. et al. | 246/5 |
| 5,072,900 A | | 12/1991 | Malon | 246/5 |
| 5,129,605 A | | 7/1992 | Burns et al. | 246/5 |
| 5,177,685 A | | 1/1993 | Davis et al. | 364/443 |
| 5,332,180 A | | 7/1994 | Peterson et al. | 246/3 |
| 5,340,062 A | | 8/1994 | Heggestad | 246/2 R |
| 5,364,047 A | | 11/1994 | Petit et al. | 246/122 R |

(Continued)

OTHER PUBLICATIONS

"Testimony of Jolene M. Molitoris, Federal Railroad Administrator, U.S. Department of Transportation before the House Committee on Transportation and Infrastructure Subcommittee on Railroads", Federal Railroad Administration, United States Department of Transportation, Apr. 1, 1998.
"System Architecture, ATCS Specification 100", May 1995.
"A New World for Communications & Signaling", Progressive Railroading, May 1986.
"Advanced Train Control Gain Momentum", Progressive Railroading, Mar. 1986.
"Railroads Take High Tech in Stride", Progressive Railroading, May 1985.
Lyle, Denise, "Positive Train Control on CSXT", Railway Fuel and Operating Officers Association, Annual Proceedings, 2000.
Lindsey, Ron A., "C B T M, Communications Based Train Management", Railway Fuel and Operating Officers Association, Annual Proceedings, 1999.
Moody, Howard G, "Advanced Train Control Systems A System to Manage Railroad Operations", Railway Fuel and Operating Officers Association, Annual Proceedings, 1993.

*Primary Examiner*—Jeffery Hofsass
*Assistant Examiner*—Jennifer Stone
(74) *Attorney, Agent, or Firm*—DLA Piper Rudnick; Gray Cary US LLP

(57) ABSTRACT

A train control system requires a train operator to enter signal aspect information at each wayside signal position on a railroad and stops the train if the operator fails to enter aspect information without communicating with the wayside signal device to verify that the information entered by the operator is correct, In some embodiments, the signal aspect information is entered by pressing a button corresponding to the signal aspect information, and the location and/or arrangement of the buttons changes. Alternatively, the operator must repeat a varying sequence (such as a series of button pushes) in conjunction with and/or in addition to entering signal aspect information.

45 Claims, 4 Drawing Sheets

U.S. PATENT DOCUMENTS

| | | | | | |
|---|---|---|---|---|---|
| 5,392,030 | A | * | 2/1995 | Adams | 340/576 |
| 5,394,333 | A | | 2/1995 | Kao | 364/450 |
| 5,398,894 | A | | 3/1995 | Pascoe | 246/28 R |
| 5,415,369 | A | * | 5/1995 | Hungate | 246/167 R |
| 5,452,870 | A | | 9/1995 | Heggestad | 246/182 R |
| 5,533,695 | A | | 7/1996 | Heggestad et al. | 246/62 |
| 5,620,155 | A | | 4/1997 | Michalek | 246/121 |
| 5,699,986 | A | | 12/1997 | Welk | 246/125 |
| 5,740,547 | A | | 4/1998 | Kull et al. | 701/19 |
| 5,751,569 | A | | 5/1998 | Metel et al. | 364/132 |
| 5,803,411 | A | | 9/1998 | Ackerman et al. | 246/169 R |
| 5,828,979 | A | | 10/1998 | Polivka et al. | 701/117 |
| 5,867,122 | A | | 2/1999 | Zahm et al. | 342/357 |
| 5,944,768 | A | | 8/1999 | Ito et al. | 701/200 |
| 5,950,966 | A | | 9/1999 | Hungate et al. | 246/62 |
| 5,978,718 | A | | 11/1999 | Kull | 701/19 |
| 5,995,881 | A | | 11/1999 | Kull | 701/20 |
| 6,049,745 | A | | 4/2000 | Douglas et al. | 701/23 |
| 6,081,769 | A | | 6/2000 | Curtis | 702/158 |
| 6,102,340 | A | | 8/2000 | Peek et al. | 246/121 |
| 6,112,142 | A | | 8/2000 | Shockley et al. | 701/19 |
| 6,135,396 | A | | 10/2000 | Whitfield et al. | 246/182 R |
| 6,179,252 | B1 | | 1/2001 | Roop et al. | 246/293 |
| 6,218,961 | B1 | | 4/2001 | Gross et al. | 340/903 |
| 6,311,109 | B1 | | 10/2001 | Hawthorne et al. | 701/19 |
| 6,322,025 | B1 | | 11/2001 | Colbert et al. | 246/167 R |
| 6,345,233 | B1 | | 2/2002 | Erick | 701/301 |
| 6,371,416 | B1 | | 4/2002 | Hawthorne | 246/122 R |
| 6,373,403 | B1 | | 4/2002 | Korver et al. | 340/988 |
| 6,374,184 | B1 | | 4/2002 | Zahm et al. | 701/213 |
| 6,377,877 | B1 | | 4/2002 | Doner | 701/19 |
| 6,397,147 | B1 | | 5/2002 | Whithead | 701/213 |
| 6,421,587 | B2 | | 7/2002 | Diana et al. | 701/19 |
| 6,456,937 | B1 | | 9/2002 | Doner et al. | 701/213 |
| 6,459,964 | B1 | | 10/2002 | Vu et al. | 701/19 |
| 6,459,965 | B1 | | 10/2002 | Polivka et al. | 701/19 |
| 6,487,478 | B1 | | 11/2002 | Azzaro et al. | 701/24 |
| 6,609,049 | B1 | | 8/2003 | Kane et al. | 701/19 |
| 2001/0056544 | A1 | | 12/2001 | Walker | |
| 2002/0070879 | A1 | | 6/2002 | Gazit et al. | |
| 2003/0225490 | A1 | | 12/2003 | Kane et al. | |

OTHER PUBLICATIONS

Ruegg, G.A., "Advanced Train Control Systems ATCS", Railway Fuel and Operating Officers Association, Annual Proceedings, 1986.

Malone, Frank, "The Gaps Start to Close"Progressive Railroading, May 1987.

"On the Threshold of ATCS", Progressive Railroading, Dec. 1987.

"CP Advances in Train Control", Progressive Railroading, Sep. 1987.

"Communications/Signaling: Vital for dramatic railroad advances", Progressive Railroading, May 1988.

"ATCS's System Engineer", Progressive Railroading, Jul. 1988.

"The Electronic Railroad Emerges", Progressive Railroading, May 1989.

"$C^3$ Comes to the Railroads", Progressive Railroading, Sep. 1989.

"ATCS on Verge of Implementation", Progressive Railroading, Dec. 1989.

"ATCS Evolving on Railroads", Progressive Railroading, Dec. 1992.

"High Tech Advances Keep Railroads Rolling", Progressive Railroading, May 1994.

"FRA Promotes Technology to Avoid Train–To–Train Collisions", Progressive Railroading, Aug 1994.

"ATCS Moving slowly but Steadily from Lab for Field", Progressive Railroading, Dec. 1994.

Judge, T., "Electronic Advances Keeping Railroads Rolling", Progressive Railroading, Jun. 1995.

"Electronic Advances Improve How Railroads Manage", Progressive Railroading, Dec. 1995.

Judge, T., "BNSF/UP PTS Pilot Advances in Northwest", Progressive Railroading, May 1996.

Foran, P., "Train Control Quandary, Is CBTC viable? Railroads, Suppliers Hope Pilot Projects Provide Clues", Progressive Railroading, Jun. 1997.

"PTS Would've Prevented Silver Spring Crash: NTSB", Progressive Railroading, Jul. 1997.

Foran, P., "A 'Positive' Answer to the Interoperability Call", Progressive Railroading, Sep. 1997.

Foran, P., "How Safe is Safe Enough?", Progressive Railroading, Oct. 1997.

Foran, P., "A Controlling Interest In Interoperability", Progressive Railroading, Apr. 1998.

Derocher, Robert J., "Transit Projects Setting Pace for Train Control", Progressive Railroading, Jun. 1998.

Kube, K., "Variations on a Theme", Progressive Railroading, Dec. 2001.

Kube, K., "Innovation in Inches", Progressive Railroading, Feb. 2002.

Vantuono, W., "New York Leads a Revolution", Railway Age, Sep. 1996.

Vantuono, W., "Do you know where your train is?", Railway Age, Feb. 1996.

Gallamore, R., "The Curtain Rises on the Next Generation", Railway Age, Jul. 1998.

Burke, J., "How R&D is Shaping the 21st Century Railroad", Railway Age, Aug. 1998.

Vantuono, W., "CBTC: A Maturing Technology", Third International Conference On Communications Based Train Control, Railway Age, Jun. 1999.

Sullivan, T., "PTC—Is FRA Pushing Too Hard?", Railway Age, Aug. 1999.

Sullivan, T., "PTC: A Maturing Technology", Railway Age, Apr. 2000.

Moore, W., "How CBTC Can Increase Capacity", Railway Age, Apr., 2001.

Vantuono, W., "CBTC: The Jury is Still Out", Railway Age, Jun. 2001.

Vantuono, W., "New–tech Train Control Takes Off", Railway Age, May 2002.

Union Switch & Signal Intermittent Cab Signal, Bulletin 53, 1998.

GE Harris Product Sheet: "Advanced Systems for Optimizing Rail Performance" and "Advanced Products for Optimizing train Performance", undated.

GE Harris Product Sheet: "Advanced, Satellite–Based Warning System Enhances Operating Safety", undated.

Furman, E., et al., "Keeping Track of RF", GPS World, Feb. 2001.

Department of Transportation Federal Railroad Administration, Federal Register, vol. 66, No. 155, pp. 42352–42396, Aug. 10, 2001.

* cited by examiner

METHOD AND SYSTEM FOR ENSURING THAT A TRAIN OPERATOR REMAINS ALERT DURING OPERATION OF THE TRAIN

BACKGROUND OF THE INVENTION

1. Field of the Invention

The invention relates to wayside signaling generally and more particularly to wayside signal acknowledgment systems.

2. Discussion of the Background

Trains are often controlled by wayside signaling systems. A wide variety of wayside signal systems are known in the art. In traditional wayside signaling systems (e.g., Automated Block signaling (ABS) and Centralized Track Control (CTC) systems), one or more colored signal lights mounted on poles alongside a track are used to direct a train operator as to how to move the train. These wayside signals may be located at various positions on the railway such as near the beginning of a block of track and near grade crossings, sidings, switches, etc.

The signal lights indicate whether and under what conditions (e.g., what speed) a train is to proceed in a section of track associated with the signal. The meaning of the wayside signal is sometimes referred to as the signal "aspect." As one simple example, a red signal indicates that a train cannot enter a section of track associated with a signal, a yellow signal indicates that the train can proceed through a section of track at a speed that will allow it to stop before entering the next section of track, and a green signal indicates that the train may proceed through a section of track at the maximum allowable speed. Other more complex signaling systems are also known in the art. On some railroads, there are over 125 different colored light signal indications that must be recognized and obeyed.

An operator is required to observe the lights and operate the train accordingly. However, train operators are human and can sometimes miss a signal, which can result in disaster. A number of systems have been designed to address this problem, but each of these systems has drawbacks that make them unsuitable for some applications.

Several of these systems, sometimes referred to as communication-based train control (CBTC) systems, involve the communication of a signal information into the cab of a train. For example, in a prior art system referred to as the Cab Signal system, wayside signals are transmitted as alternating current signals from wayside signal equipment through the rails of the train track, where they are picked up by inductive coils mounted on the locomotive and displayed to the operator on a display located in the locomotive cab. The Cab Signal system forces the operator to acknowledge signals that are more restrictive than the current signal and, in some systems, will activate the train's brakes to stop the train if a signal is not obeyed. However, this system has several drawbacks. First, it requires the installation of expensive wayside equipment to transmit the signal to the locomotive cab through the rails.

Second, the system only requires acknowledgment of signals. Simply requiring acknowledgment of signals does not ensure that an operator is alert. It is known to those of skill in the art that operators can successfully acknowledge signals while in only a semi-conscious state referred to as "micro-sleep." Although some embodiments of the cab signal system will stop the train if a signal is not obeyed, this after-the-fact response may not be sufficient to prevent an accident. Furthermore, neither a semi-conscious crew member nor the cab signal system may respond to events such as a person or other obstruction on a train track for which the wayside signaling system does not provide a warning, whereas a fully alert crew member could take appropriate action in such an event.

Third, the cab signal system does not force an operator to acknowledge less restrictive signals. This is disadvantageous because if an operator misses a less restrictive signal, the operator may miss an opportunity to operate the train more efficiently by increasing the speed of the train.

Other systems involve the transmission of wayside signals to the cab of the train using radio-based communications. In these systems, signal information is broadcast to the cab of the train using radio frequency transmissions. Although the radio frequency communication equipment used in such systems is less expensive than the equipment used in the cab signal systems, it still increases costs, especially in a railroad in which a wayside signaling system is already in place.

There is a system described in U.S. Pat. No. 6,112,142 (the contents of which are hereby incorporated by reference herein), which is owned by the assignee of the present invention, that does not require wayside communication equipment in addition to existing wayside signal equipment. In that system, an engineer and a trainman are each provided with a combined display/input device referred to therein as a pendant. When a train with such a system approaches a signal, both the engineer and the trainman must agree as to the signal aspect by pressing corresponding buttons on the pendant corresponding to the signal aspect. If both the engineer and the trainman agree as to the signal aspect, the system will automatically ensure compliance with the signal. If the engineer and the trainman do not agree as to the signal aspect, or do not operate the train in compliance with the signal, the system will take corrective action to enforce the signal and/or stop the train. Some embodiments of that system combine a global positioning system or inertial navigation system with a track database containing the locations of wayside signals to provide the train crew with a signal proximity warning and will stop the train if the train crew fails to acknowledge this warning. While this system is advantageous in that it does not require any equipment to transmit signals to trains in the system in addition to a wayside signaling system, it has the drawback of requiring two crew members.

What is needed is a system and method that overcomes these and other deficiencies in known systems.

BRIEF SUMMARY OF THE INVENTION

The present invention meets the aforementioned need to a great extent by providing a train control system that requires a train operator to enter signal aspect information at each wayside signal position on a railroad and that stops the train if the operator fails to enter aspect information. This is an improvement over systems in which the operator is only required to acknowledge the signal (e.g., by pressing a general purpose acknowledgment button regardless of the meaning of the signal) because it ensures that the operator is alert and is not simply reflexively acknowledging the signal. In some embodiments of the invention, the signal aspect information is entered by the operator by pressing a button corresponding to the signal aspect information, and the location of the button is changed. In other embodiments of the invention, the operator must repeat a varying sequence (such as a series of button pushes) in conjunction with or in addition to entering signal aspect information.

In preferred embodiments of the invention, the system includes a controller, a track database including the positions of all signals in a system, a positioning system that supplies the controller with a position of the train, and an input device that an operator uses to enter signal aspect information. The controller determines when the train is approaching a wayside signal based on the information from the positioning system and the track database. The controller will wait for and, if necessary, warn the operator to enter, signal aspect information for the approaching signal. If the operator fails to enter any information within a timeout period, the controller takes corrective action. In some embodiments, the corrective action comprises activating a warning device and/or activating the train's brakes to stop the train. If the operator enters signal aspect information, the processor will ensure that the train is operated in compliance with the signal and will take corrective action if the operator attempts to operate the train in a noncompliant manner.

In some embodiments, the controller dynamically determines the amount of time necessary lo stop the train based on the train's speed, weight, and other factors and sets the timeout period accordingly. In other embodiments, the timeout period is predetermined based on a worst-case assumption (e.g., fastest possible speed, greatest weight, steepest downhill grade of track, etc.) of the time required to stop the train. If the operator fails to enter a matching signal within the timeout period, corrective action is taken.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of train control systems. Specific details, such as types of signals, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
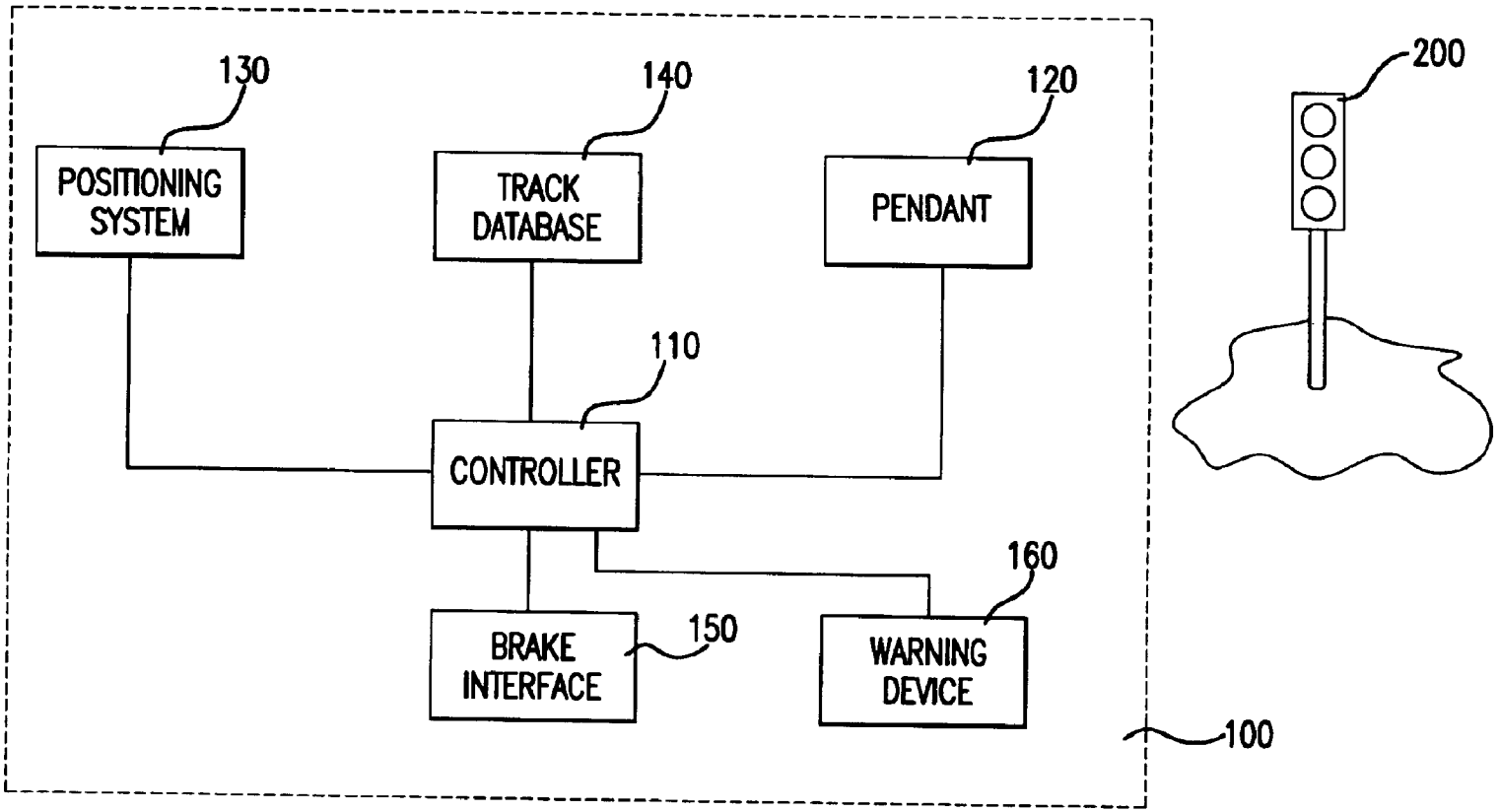
FIG. 1 is a block diagram of one embodiment of the invention.

A train control system 100 is illustrated in FIG. 1. The system 100 includes a controller 110. The controller 110 may be a microprocessor or may be implemented using discrete components. The controller 110 is responsible for implementing the logical operations discussed in detail below.

An operator pendant 120 is connected to the controller 110. The operator pendant 120 is illustrated in further detail in FIG. 2. The operator pendant 120 includes a display panel 121 and a signal entry panel 230. Although these panels 121, 130 are illustrated as separate, they are also combined in some embodiments of the invention. The signal entry panel 230 includes a series of 12 buttons 231–242 labeled as 1 CLR (clear), 2 LTD (limited), 3 APP (approach), 4 MED (medium), 5 DIV (diverging), 6 SLOW, 7 ADV (advance), 8 RES (restricted), 9 STOP/PROC (1 push=stop, 2 pushes=proceed), 10 COND O'RIDE (conditional override), 11 ACK/ENTER (acknowledge/enter—depends upon context); and 12 CANCEL, respectively. Buttons 231–240 correspond to various signals defined in the GCOR (General Code of Operational Rules) and various other signaling systems used in the United States. The ACK/ENTER and CANCEL buttons 241 and 242 are used to acknowledge warnings, enter information, and cancel a previous entry, respectively.

The buttons 231–242 are used by the operator to enter a signal displayed on a wayside signaling device. For example, if the wayside signal device displayed a "medium approach medium" signal (which means that the train is allowed to travel at medium speed through turnouts, crossovers, sidings and over power operated switches, then proceed, approaching the next signal at a speed not exceeding the medium speed), the operator would depress the MED button 234, the APP button 233, and the MED button 234 in that order.

Figure 2:
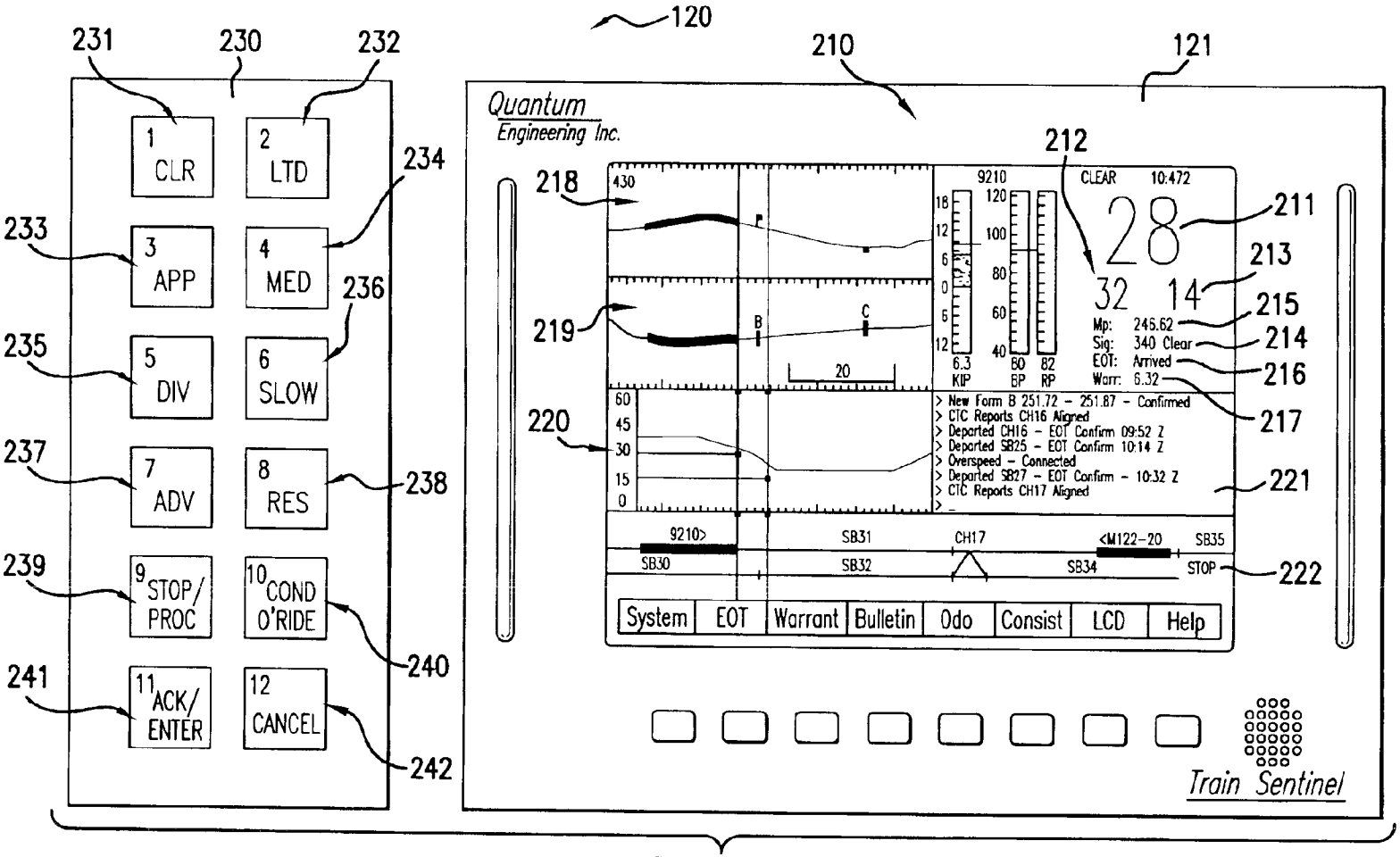
FIG. 2 is a front view of a pendant of the embodiment of FIG. 1.

The pendant 120 also includes a display panel 121 with a window 210, which is preferably a graphics-capable display (a liquid crystal display is illustrated in FIG. 2, but any graphics display could be used). The window 210 includes a current speed field 211, a maximum speed field 212, an acceleration field 213 (which indicates what the speed of the train will be in one minute at the current acceleration), a signal field 214 (which illustrates the distance in feet to the next signal and the status of that signal), a milepost field 215, an EOT field 216 indicating whether or not the EOT unit is armed (signifying whether or not the EOT unit can provide an emergency braking operation), a track warranty field 217 indicating the distance in miles to the end of the current track warrant, an elevation profile window 218, a track curvature window 219, and a braking curve window 220. The window 210 also displays, in window 221, messages received from the dispatcher and, in window 222, track configuration and status information, including a display of other trains (e.g., train M122 in FIG. 2). The buttons surrounding the window 210 are "soft keys" that have different, programmable functions, which are beyond the scope of the present invention, depending on the content of the display 210 in a manner well known in the art.

In embodiments of the invention in which the signal entered by the operator is displayed, the signal may be displayed in a "pop-up" window in the window 210. In other embodiments, the signal may only be displayed in the signal field 214 as discussed above. In other embodiments, no visual indication of the signal device 200 is provided on the pendant 120.

Referring now back to FIG. 1, also connected to the controller 110 is a positioning system 130. The positioning system 130 is a GPS receiver in preferred embodiments. The GPS receiver can be of any type, including a differential GPS, or DGPS, receiver. Other types of positioning systems 130, such as inertial navigation systems (INSs), Loran systems, and wheel tachometers can also be used. Such positioning systems are well known in the art and will not be discussed in further detail herein. (As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that are used to transmit information to the GPS receiver.)

The positioning system 130 continuously supplies the controller 110 with position information for the train to which the system 100 is attached. This position information allows the controller 110 to determine where the train is at any time. The positioning system 130 is preferably sufficiently accurate to unambiguously determine which of two adjacent tracks a train is on. By using train position information obtained from the positioning system 130 as an index into a track database 140 (discussed in further detail below), the controller 110 can determine the train's position relative to wayside signal devices 200 in the railroad.

A track database 140 is also connected to the controller 110. The track database 140 preferably comprises a non-volatile memory such as a hard disk, flash memory, CD-ROM or other storage device, on which track data and the locations of wayside signal devices is stored. Other types of memory, including volatile memory, may also be used. The track data preferably also includes positions of switches, grade crossings, stations and anything else of which an operator is required to or should be cognizant. The track data preferably also includes information concerning the direction and grade of the track.

A brake interface 150 connected to the controller 110 allows the controller 110 to activate and control the train brakes when necessary to slow and/or stop the train. Brake interfaces are well known in the art and will not be discussed in further detail herein.

Finally, some embodiments of the invention include a warning device 160 separate from the pendant 120. The warning device 160 may be a light or an audible device such as a bell or horn that will get the operator's attention if he is not looking in the direction of the pendant 120.

Figure 3:
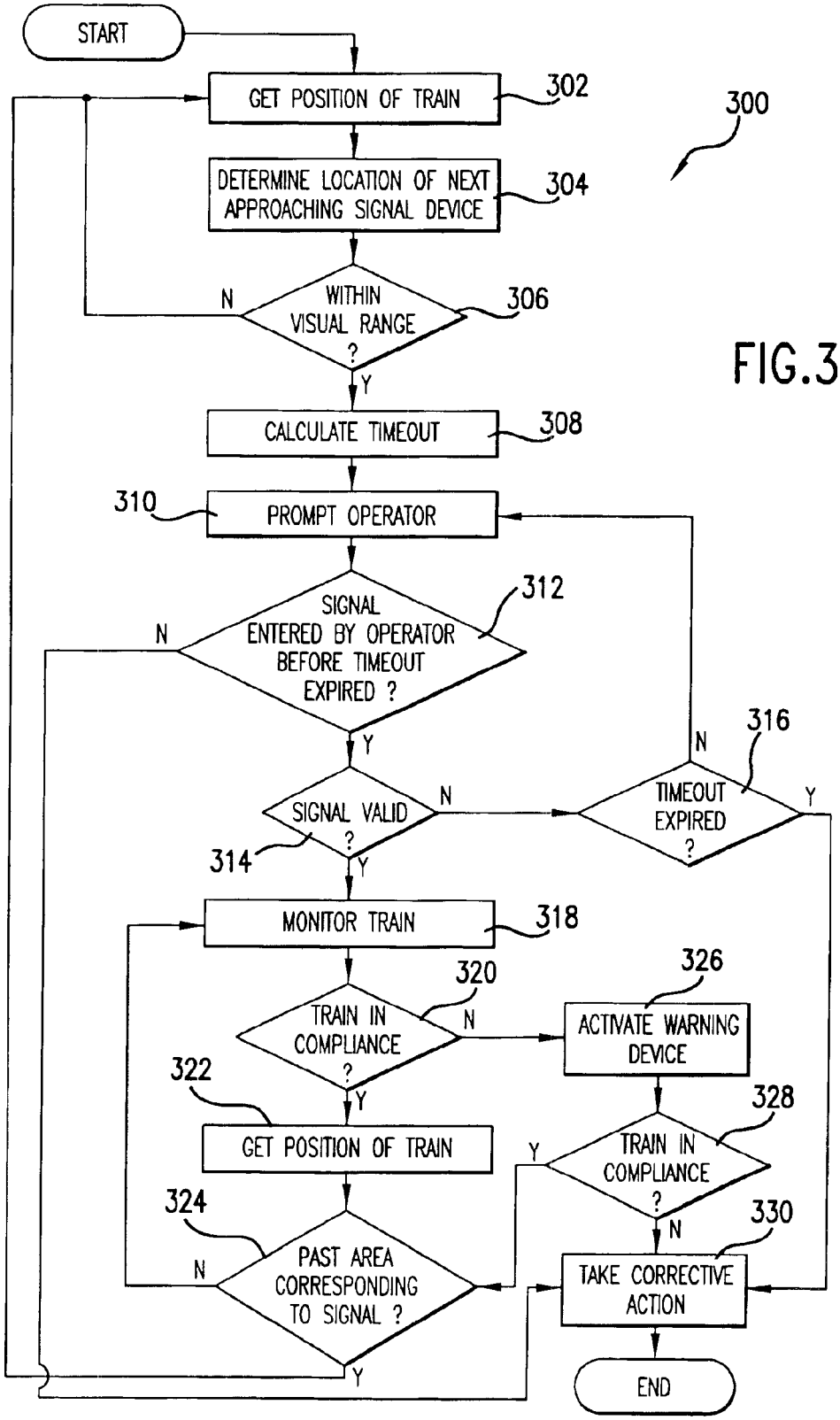
FIG. 3 is a flow chart illustrating operation of the system of FIG. 1.

A flowchart 300 illustrating operation of the system 100 is shown in FIG. 3. The process starts with the controller 1 10 querying the positioning system 130 to determine the position of the train at step 302. The controller 110 then consults the track database 140 to determine the nearest approaching signaling device 200 based on the train's position at step 304. Next, the controller 110 determines whether the signaling device 200 is within an expected visual range at step 306.

The expected visual range is a fixed threshold based on a distance at which an operator with normal vision can be expected to see a signal on a clear day. Of course, any particular signal on any particular day may actually be visible at a different distance. The expected visual range is simply a distance chosen so that the operator is prompted at a reasonable distance from the signal, i.e., to avoid prompting the operator at a distance so far away that it would be impossible for the operator to see the signal, while at the same time being far enough away to allow the operator sufficient time to enter the signal before corrective action is taken.

If the nearest device is not within visual range, steps 302 and 304 are repeated until the next signaling device 200 is within visual range. When the next device 200 is within visual range at step 306, the controller 110 then determines at step 308 a timeout within which a signal must be received from the device 200 and a matching signal must be received from the operator's pendant 120. The timeout is chosen such that, at the expiration of the timeout, there will be sufficient distance and time in which to stop the train in the event of a problem (e.g., no signal is entered by the operator or the signal entered by operator does not match the signal received from the device).

The timeout is dynamically determined in some embodiments using factors such as the speed and weight of the train, the distance between the train and the upcoming signaling device 200, the grade of the upcoming section of track, the distribution of weight on the train, and/or the characteristics of the braking system on the train in a manner well known in the art. In other embodiments, the timeout is a fixed period based upon a worst-case assumption about the distance required Next, at step 310, the controller 110 prompts the operator (which can be done using a pop-up window on the pendant 120 and/or by activating the warning device 160) to enter the signal aspect from the approaching signal device identified at step 304. If the operator enters a signal before the expiration of the timeout at step 312, the controller determines if the entered signal is valid for the railway on which the train is located. If the signal is not valid at step 314 and if the timeout has not yet expired at step 316, steps 310 et seq. are repeated. If the timeout has expired at step 316, corrective action (as described further below) is taken at step 330.

If the controller determines that a valid signal has been entered at step 314, the controller monitors the train to ensure that it is in compliance with the signal at step 318. In most instances, compliance with the signal is determined by monitoring the train's speed, which can be done using inputs from the positioning system 130, a wheel tachometer, or any other means available to the controller 110. If the train is in compliance with the signal at step 320, the controller 110 obtains an updated train position from the positioning system 130 at step 322. If the train has not yet passed the area corresponding to the signal (e.g., a block of track in an ABS system) at step 324, steps 318 et seq. are repeated. If the train has passed the area corresponding to the signal at step 324, steps 302 et seq. are repeated.

If the train is not in compliance with the signal at step 320, a warning device 160 is activated at step 326. As discussed above, the warning device 160 may form part of the pendant 120 or may be a separate device such as a horn or buzzer. After the warning device has been activated, and after waiting an amount of time to allow the operator to take action to bring the train in compliance with the signal if it is safe to do so, the controller 110 again determines if the train is in compliance with the signal at step 328. If the train is in compliance, steps 324 et seq. are repeated. If the train is still not in compliance with the signal at step 328, corrective action is taken at step 330.

The corrective action at step 330 may take a variety of forms. In some embodiments, the controller 110 may activate the brakes of the train through the brake interface 150 such that the train is brought to a stop. At this point, some embodiments of the system require authorization from a dispatcher in order to start the train moving again. Other embodiments require the operator to perform a start up procedure. Yet other embodiments simply allow further movements after the stop on the basis that such further movements require active participation of the operator. In other embodiments, the controller 110 may activate the brakes such that the speed of the train is reduced to either the speed allowed in the block and/or a required speed as calculated for a braking curve based on one or more of the following factors: the weight, speed and position of the train, the distribution of weight on the train, and the grade of the track. Braking curves and their associated calculations are well known in the art and will not be discussed in further detail herein. The corrective action may also include notifying a dispatcher in embodiments that provide for communication between the system 100 and a dispatcher.

In some embodiments, the system 100 will become "active" anytime (1) any switch button is used or (2) anytime the speed of the locomotive is greater than 15 mph. These features make the system unobtrusive during railyard switching operations. Also, when speed increases above 15 mph the system 100 will require an initial acknowledgment by the operator. After this initial acknowledgment the system will require operator acknowledgments at set intervals mandatorily such as one (1) hour between pendant activity as long as the train speed is above 15 mph and no signal button has been depressed in the last hour. In the event that speed is reduced to a "stop" and then increased to greater than 15 mph without any intervening button operation, the system will "force" an acknowledgment to further check the system 100 and the operator's actions.

As discussed above, compliance with the signal from the wayside signaling device 200 is monitored at step 320. An example of non-compliance is if the speed of the train exceeds the "target" speed for a given signal by a prescribed speed over the target speed and the train is not decelerating, at a target deceleration amount (e.g., 1 mph/min). In some embodiments, if an initial determination of non-compliance is made, a response timer will be set and automatic braking will occur upon timeout of the response timer unless (1) the speed of the train is reduced to less than 5 mph above the "target speed"; (2) the train is decelerating at an acceptable rate; or (3) the speed of the train is brought below the "target speed".

In order to further ensure that an operator is alert, some embodiments of the invention employ an operator pendant 120 on which the position of the buttons by which the operator enters signal aspect information is modified. The buttons may be changed each time an operator enters signal aspect information, periodically, or on some other basis.

Figure 4A:
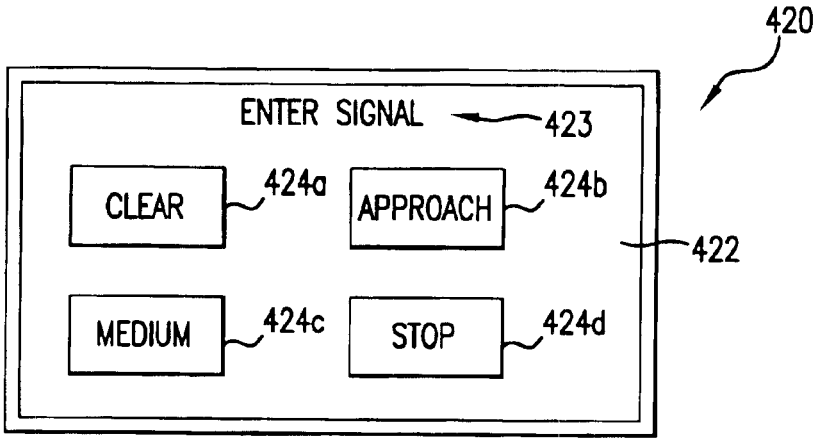
FIGS. 4(*a*) and (*b*) are front views of a pendant with changeable buttons according to a second embodiment of the invention.
Figure 4B:
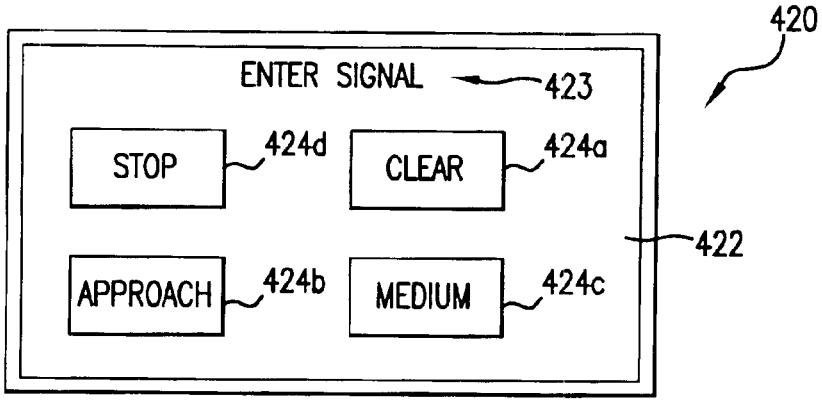

A pendant 420 for use in such an embodiment is illustrated in FIG. 4(*a*) and (*b*). The pendant 420 preferably comprises a touch screen 422 with reprogrammable buttons 424 in a manner well known in the art.

The screen view of FIG. 4(*a*) is displayed to the operator when the controller 110 determines that the train is within visual range of a wayside signal device. The screen view of FIG. 4(*a*) includes a prompt to the operator to enter signal information and four buttons 424*a–d* labeled clear, approach, medium, and stop, respectively. This configuration is used in connection with a wayside signaling system in which all signals are formed using only these four aspects. Additional buttons 424 with other aspects (such as the additional aspects shown in FIG. 2) are used in embodiments with more than four aspects. The operator enters the aspect information by touching the buttons 424. For example, for an "approach medium" signal, the operator would press the "approach" and "medium" buttons 424*b* and 424*c*. Alternatively, for a clear signal, the operator would simply press the clear button 424*a*.

In the examples discussed above, it should be recognized that it is possible for an operator to fool the system 100 by entering a clear signal (e.g., pressing the clear button 424*a*) regardless of what signal is displayed by the wayside signal device 200. If such an operator were to make a habit of fooling the system 100 in this manner, there is a possibility that the operator may develop a reflex reaction that will allow him to continually hit the clear button 424*a* when prompted to enter a signal. In a worst-case situation, such a reflex reaction might allow the operator to enter a state of micro-sleep while successfully entering signals. In order to prevent this, it is preferable to change the position of the buttons 424 on the pendant 420. For example, after an operator enters a signal with the pendant 420 configured as shown in FIG. 4(*a*), the location of the buttons 424 may be re-arranged as illustrated in FIG. 4(*b*) when the operator is prompted to enter a signal at the next wayside device 200. In this manner, if the operator reflexively presses the same button in the upper left-hand comer of the pendant 420 a second time, a "stop," will be entered, which will be enforced by the controller 110 by automatically activating the brakes of the train to bring it to a halt.

The buttons 424 of the pendant 420 may be rearranged at random times, at some multiple of the number of signals entered by the operator, periodically (e.g., at the one hour intervals discussed above), or any other basis; but is rearranged each time an operator enters a signal in preferred embodiments. Also, the manner in which the signals are rearranged may also be varied. For example, in some embodiments, the stop button replaces whatever button was last used by the operator. It is also possible to randomly rearrange the buttons, or to rearrange them on other bases. Furthermore, in the example used above, the buttons 424 are always arranged at the same locations although the order in which the buttons are placed in those locations changes. In other embodiments, the locations of the buttons may also change such that a particular location on a screen is sometimes within a first button, sometimes within another button, and sometimes not within any button. This prevents an operator from being able to enter signal information by simply pressing the same area of the display over and over in response to prompts to enter signal information. In such embodiments, a smaller button size as compared to what is shown in FIGS. 4(*a*) and (*b*) is preferable.

Figure 5:
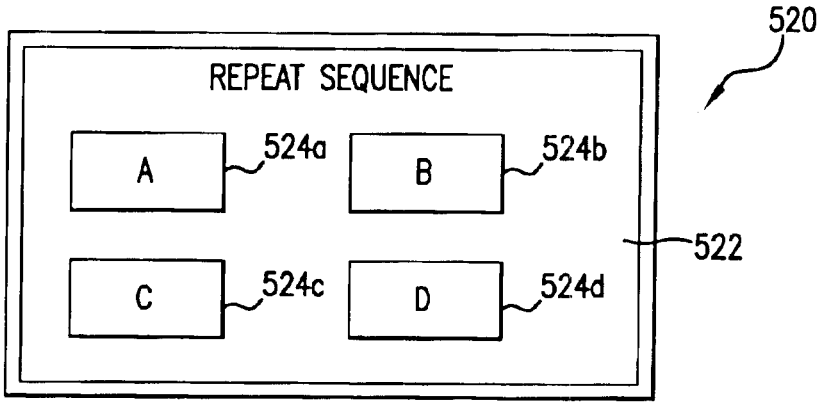
FIG. 5 is a front view of a pendant according to a third embodiment of the invention.

Another technique that can be used to guard against operator inattentiveness is to repeatedly require an operator to repeat a time-varying sequence. The time varying sequence may comprise a plurality of button pushes. A display 520 useful in such an embodiment is illustrated in FIG. 5. The display 520 includes a plurality of buttons 524*a–d* labeled A, B, C, D, respectively. In one embodiment, the buttons 524 are successively illuminated in a varying sequence (e.g., BCDA one time, ABDC the next time, etc.) and the operator is required to repeat the sequence by pressing the buttons 524 in the same order in a manner similar to the popular electronic game SIMON™, available from Milton Bradley. In other embodiments, the operator may be asked to repeat the same sequence each time, but the location of the buttons changes in the manner similar to that described above in connection with FIGS. 4(*a*) and 4(*b*).

The operator may be asked to repeat a sequence each time a signal is to be entered. Additionally or in lieu of requiring the operator to mimic the sequence when entering a signal, the operator may be required to repeat the sequence periodically (e.g., at the one hour intervals described above) or at random times. The consequence of a failure to correctly repeat a sequence can also vary. In some embodiments, a failure to correctly repeat the sequence results in the controller 110 activating the brakes to stop the train. In other embodiments, the operator is given a second opportunity to correctly enter the sequence if time is available to do so safely. Other consequences are also possible.

In the embodiments described above, the pendants 420, 520 may be physically separate from the pendant 120 of FIG. 2. Alternatively, the pendants 420, 520 may be incorporated into the pendant 120 of FIG. 2. In one embodiment, the pendant 420 or 520 replaces the window 210 of the pendant 120 of FIG. 2. In yet other embodiments, the window 210 together with the soft keys 210 are used to implement the techniques discussed above in connection with the touch screen pendants 420, 520.

For example, the window 210 of the pendant 120 may display a scene similar to that of FIG. 4(*a*), with each of the buttons 424*a–d* of FIG. 4(*a*) being associated one of the soft keys surrounding the window 210 on pendant 120. The association may be made on the basis of physical proximity of a button 424*a–d* to a nearest soft key, in which the rearrangement of the buttons 424*a–d* in the window 210 would result in a change the association between individual soft keys and buttons 424*a–d*.

Alternatively, each of the soft keys may have a number permanently associated with it, and that number of a corresponding soft key may be displayed on the buttons 424*a–d*. In such embodiments, the rearrangement of buttons may be accomplished by changing the soft key number displayed on the buttons 424*a–d* in lieu of or in addition to changing the location of the buttons 424*a–d*. Other variations on this technique are also possible. Similar techniques may be utilized to require the operator to press different sequences of soft keys to implement the varying sequence technique discussed above in connection with FIG. 5.

It should be noted that the techniques described in connection with FIGS. 4(*a*), 4(*b*) and 5 may be used in a wide variety of settings, including systems in which communications with wayside signaling devices occurs, such as the system described in U.S. patent application Ser. No. 10/300,852, filed Nov. 21, 2002 and entitled "Improved Positive Signal Comparator and Method" (the "'852 application"), the contents of which are hereby incorporated by reference herein. For example, at step 316 of the method described in FIG. 3 of the '852 application, the operator is prompted to enter a signal corresponding to a signal received from a wayside signaling device via a transceiver located on the train. This step 316 may be performed using one of the techniques described in connection with FIGS. 4(*a*), 4(*b*) and 5 of this application. In such an embodiment, the signal received from the wayside signaling device is compared to the signal entered by the operator and corrective action is taken if the signals do not match.

In addition to ensuring compliance with wayside signaling devices 200, the system 100 may also ensure compliance with "slow order" or speed restriction information for the territory to be traversed by the train. In such embodiments, "slow order"/speed restriction information is stored in the database 140 and is treated in a manner similar to signals from wayside devices 200 (e.g., when the train approaches the start of a section of track covered by a slow order or speed restriction, the slow order/speed restriction information is displayed to an operator on the pendant 120 in a "pop up" window, and the controller 110 takes corrective action if the slow order/speed restriction is not complied with.)

Several methods for updating the "slow order"/speed restriction information are available including:

A. Operator Update:

The train crew must "sign up" before boarding the train. The operator can be given a credit card sized memory device or some similar device having the latest track information at the "sign up" location. After receiving this data, a crewman can board the train and read this latest data into the database 140.

B. Radio Update:

At prescribed railroad locations, a low power transmitter can be employed to automatically update the database 140. Employing radio communications to update the database 140 does not necessarily vitiate one of the advantages of the invention discussed above; namely, the ability to employ the system as a "retrofit" to a railroad with an existing visual wayside signaling system. This is because it is possible to use the radio update feature with a radio communications system that covers only limited areas of the system such that the databases of trains on the system become updated when they travel on such limited areas. Furthermore, it should be noted that the invention is not limited to use in a retrofit context and that not all embodiments of the invention necessarily include this or any other advantage discussed herein.

C. Computer Update:

During mechanical inspections, a laptop or other memory device could be used to update the database 140. In such embodiments, the pendant 120 preferably displays the date the system was last updated so the crew can verify that they have the latest data.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. A method for promoting operator awareness during operation of a train comprising the steps of:

determining when a train is near a wayside signal device;

prompting an operator to enter a signal displayed on the wayside signal device;

accepting a signal from the operator;

taking corrective action if no signal is entered by the operator or if a signal entered by the operator is not a valid signal; and allowing the train to proceed without taking corrective action if the train is operated in compliance with the signal entered by the operator.

2. The method of claim 1, wherein the corrective action includes activating a brake on the train.

3. The method of claim 2, wherein the brakes are activated so as to stop the train.

4. The method of claim 1, wherein the corrective action includes activating a warning device on the train.

5. The method of claim 4, wherein the warning device is an audible warning device.

6. The method of claim 1, further comprising the step of displaying the signal on a display device.

7. The method of claim 1, further comprising the step of calculating a timeout period by which the operator must enter a signal in response to the prompt, wherein the step of taking corrective action is performed if the operator fails to enter a valid signal within the timeout period.

8. The method of claim 1, wherein the determining step is performed by obtaining location information corresponding to the wayside signal device from a database, obtaining position information corresponding to the train, and calculating a distance from the train to the wayside signal device using the position information and the location information.

9. The method of claim 8, wherein the position information is obtained from a positioning system.

10. The method of claim 9, wherein the positioning system is a global positioning system.

11. The method of claim 1, further comprising the step of reconfiguring a device used by the operator to enter signal information in response to the prompting step.

12. The method of claim 11, wherein the device comprises a plurality of buttons corresponding to possible signal aspects, and the reconfiguring step is performed by modifying a location of at least one button.

13. The method of claim 12, wherein the location of the at least one button is modified by moving the at least one button to a location previously occupied by another button.

14. The method of claim 1, further comprising the step of:

prompting an operator to repeat a first sequence;

displaying the first sequence to the operator;

receiving a sequence entered by the operator in response to the prompting step; and taking corrective action if the sequence received from the operator is different from the first sequence.

15. The method of claim 14, further comprising the steps of:

modifying the first sequence to produce a second sequence different from the first sequence; and repeating the prompting step using the second sequence.

16. The method of claim 15, wherein the modifying step is performed each time the prompting step is performed.

17. The method of claim 14, wherein the prompting step is performed each time the operator is prompted to enter a signal displayed on the wayside signal device.

18. A train control system comprising:

a controller located on a train;

an input device connected to the controller, the input device being configured is to accept a signal from an operator of the train and to provide the signal to the controller;

a track database connected to the controller, the track database including a location of at least one wayside signal device; and a positioning system in communication with the controller, the positioning system being located on the train and being configured to provide a position of the train to the controller;

wherein the controller is configured to perform the steps of:

determining when a train is near the at least one wayside signal device based on a position of the train received from the positioning system and a location of the device received from the track database;

prompting an operator to enter a signal displayed on the at least one wayside signal device;

accepting a signal from the operator;

taking corrective action if no signal is entered by the operator or if the signal entered by the operator is not a valid signal; and allowing the train to proceed if possible to do so in compliance with the signal accepted from the operator without communicating with the wayside signal device to determine if the signal accepted from the operator matches the signal displayed on the at least one wayside signal device.

19. The system of claim 18, further comprising:

a brake interface connected to the controller, the brake interface being configured to operate a brake on the train in response to a control signal from the controller;

wherein the corrective action taken by the controller includes the step of stopping the train by operating the brakes via the brake interface.

20. The system of claim 19, wherein the corrective action further includes the step of preventing the train from continuing until permission to continue is received from a dispatcher.

21. The system of claim 18, further comprising:

a warning device connected to the controller;

wherein the corrective action includes activating the warning device.

22. The system of claim 18, further comprising:

a first display device connected to the controller;

wherein the controller is further configured to display the wayside signal on the first display device.

23. The system of claim 18, wherein the positioning system is a global positioning system.

24. The system of claim 18, wherein the controller is further configured to perform the step of calculating a timeout period by which the operator must enter a signal in response to the prompt and wherein the step of taking corrective action is performed if the operator fails to enter a valid signal within the timeout period.

25. The system of claim 18, wherein the controller is further configured to reconfigure the input device.

26. The system of claim 25, wherein the input device comprises a plurality of buttons corresponding to possible signal aspects, and the reconfiguring step is performed by modifying a location of at least one button.

27. The system of claim 26, wherein the location of the at least one button is modified by moving the at least one button to a location previously occupied by another button.

28. The system of claim 18, wherein the controller is further configured to perform the step of:

prompting an operator to repeat a first sequence;

displaying the first sequence to the operator;

receiving a sequence entered by the operator in response to the prompting step; and taking corrective action if the sequence received from the operator is different from the first sequence.

29. The system of claim 28, wherein the controller is further configured to perform the steps of:

modifying the first sequence to produce a second sequence different from the first sequence; and repeating the prompting step using the second sequence.

30. The system of claim 29, wherein the modifying step is performed each time the prompting step is performed.

31. The system of claim 28, wherein the prompting step is performed each time the operator is prompted to enter a signal displayed on the wayside signal device.

32. A method for promoting train operator alertness comprising the steps of:

prompting an operator to enter a first signal corresponding to a wayside signal device;

accepting the first signal on an input device from the operator, the input device including a plurality of buttons for entry of the signal; and rearranging the buttons.

33. The method of claim 32, further comprising the steps of:

receiving a second signal from a wayside signaling device;

comparing the first signal to the second signal; and taking corrective action if the first signal does not match the second signal.

34. A method for promoting train operator alertness comprising the steps of:

prompting an operator to repeat a sequence, accepting a sequence from the operator, comparing the sequence from the operator to the sequence of the prompting step, and taking corrective action if the sequence from the operator does not match the sequence of the prompting step.

35. The method of claim 34, wherein the prompting step is performed at random intervals.

36. The method of claim 34, wherein the prompting step is performed at periodic intervals.

37. The method of claim 34, wherein the prompting step is performed in connection with entry of a first signal by the operator, the first signal corresponding to a wayside signal device.

38. The method of claim 37, further comprising the steps of:

receiving a second signal from the wayside signaling device;

comparing the first signal entered by the operator to the second signal; and taking corrective action if the first signal does not match the second signal.

39. The method of claim 37, further comprising the step of taking corrective action if the first signal is not valid.

40. A train control system comprising:

a controller located on a train;

an input device connected to the controller, the input device being configured to accept a signal from an operator of the train and to provide the signal to the controller, the signal being entered by the operator using one of more of a plurality of buttons;

a track database connected to the controller, the track database including a plurality of locations, each of the locations corresponding to one of a plurality of wayside signal devices; and a positioning system in communication with the controller, the positioning system being located on the train and being configured to provide a position of the train to the controller;

a receiver connected to the controller, the receiver being configured to receive a signals from the wayside signal device;

wherein the controller is configured to perform the steps of:

determining when a train is near a wayside signal device based on a position of the train received from the positioning system and a location of the device received from the track database;

prompting an operator to enter a signal displayed on the wayside signal device;

receiving a first signal from the operator via the input device;

receiving a second signal from the wayside signal device via the receiver;

taking corrective action if the first signal does not match the second signal or if the train is not operated in compliance with the second signal; and rearranging the buttons after the first signal is received.

41. The train control system of claim 40, further comprising a transmitter connected to the controller, wherein the controller is further configured to perform the step of transmitting an interrogation message to the wayside signal device via the transmitter when the train is near the wayside signal device.

42. The train control system of claim 40, wherein the corrective action includes activating a brake on the train.

43. The train control system of claim 42, wherein the buttons are rearranged by moving the buttons.

44. The train control system of claim 42, wherein the input device comprises a touch screen and the buttons are displayed on the touch screen.

45. A train control system comprising:

a controller located on a train;

an input device connected to the controller, the input device being configured to accept a signal from an operator of the train and to provide the signal to the controller;

a track database connected to the controller, the track database including a plurality of locations, each of the locations corresponding to one of a plurality of wayside signal devices; and a positioning system in communication with the controller, the positioning system being located on the train and being configured to provide a position of the train to the controller;

a receiver connected to the controller, the receiver being configured to receive a signal from the wayside signal device;

wherein the controller is configured to perform the steps of:

determining when a train is near a wayside signal device based on a position of the train received from the positioning system and a location of the device received from the track database;

prompting an operator to repeat a sequence when the train is near the wayside signal device;

accepting a sequence from the operator via the input device;

taking corrective action if the sequence from the operator is incorrect;

prompting an operator to enter a signal displayed on the wayside signal device;

receiving a first signal from the operator via the input device;

receiving a second signal from the wayside signal device via the receiver; and taking corrective action if the first signal does not match the second signal.

* * * * *

UNITED STATES PATENT AND TRADEMARK OFFICE

CERTIFICATE OF CORRECTION

PATENT NO. : 6,903,658 B2
APPLICATION NO. : 10/671625
DATED : June 7, 2005
INVENTOR(S) : Kane et al.

It is certified that error appears in the above-identified patent and that said Letters Patent is hereby corrected as shown below:

Column 11, Line 32, Claim 18, "configured is to accept" should read -- configured to accept --

Column 12, Line 66, Claim 34, after "a sequence" insert
-- displayed on a wayside signal device --

Column 13, Line 39, Claim 40, delete "a signals" and insert therefor -- a signal --

Signed and Sealed this

Fifth Day of September, 2006

JON W. DUDAS
*Director of the United States Patent and Trademark Office*